US005738584A

United States Patent [19]

Ikematsu et al.

[11] Patent Number: 5,738,584

[45] Date of Patent: Apr. 14, 1998

[54] KIT FOR DEVELOPING ATTRACTIONS IN A SHOOTING GAME SYSTEM

[75] Inventors: Shinichi Ikematsu; Hiroshi Kawakami; Satoshi Nakano; Tatsuya Kouno; Keisuke Hiromi; Masakazu Yoshimoto, all of Ohta-Ku, Japan

[73] Assignee: Sega Enterprises, Ltd., Tokyo, Japan

[21] Appl. No.: 681,514

[22] Filed: Jul. 23, 1996

Related U.S. Application Data

[62] Division of Ser. No. 418,029, Apr. 6, 1995, Pat. No. 5,613,913.

[30] Foreign Application Priority Data

Apr. 6, 1994 [JP] Japan ..... 6-90761

[51] Int. Cl.[6] ..... A63F 9/22

[52] U.S. Cl. ..... 463/52

[58] Field of Search ..... 463/52, 7; 273/371, 273/374, 460; 364/410; 434/11, 16, 21, 22

[56] References Cited

U.S. PATENT DOCUMENTS

| | | | |
|---|---|---|---|
| 2,188,292 | 1/1940 | Hall et al. . | |
| 2,404,653 | 7/1946 | Plebanek . | |
| 4,533,144 | 8/1985 | Juarez et al. . | |
| 4,545,583 | 10/1985 | Pearman et al. . | |
| 4,695,058 | 9/1987 | Carter III et al. . | |
| 4,772,028 | 9/1988 | Rockhold et al. . | |
| 4,934,937 | 6/1990 | Judd . | |
| 5,232,227 | 8/1993 | Bateman . | |
| 5,320,358 | 6/1994 | Jones | 273/371 X |
| 5,320,362 | 6/1994 | Bear et al. . | |
| 5,351,966 | 10/1994 | Tohyama et al. . | |
| 5,354,057 | 10/1994 | Pruitt et al. . | |
| 5,382,026 | 1/1995 | Harvard et al. . | |

FOREIGN PATENT DOCUMENTS

| | | |
|---|---|---|
| 40277 | 4/1991 | European Pat. Off. . |
| 534712 | 3/1993 | European Pat. Off. . |
| 509786 | 10/1930 | Germany . |
| 63-61898 | 3/1988 | Japan . |
| 3 123579 | 5/1991 | Japan . |
| 4 31118 | 7/1992 | Japan . |

OTHER PUBLICATIONS

International Defense Review, vol. 21, No. 11, Nov. 1988, Conintrin–Geneva CH, pp. 1465–1466, Roger Frost, "Public Enemy No. 1".

*Primary Examiner*—Jessica Harrison
*Assistant Examiner*—Michael O'Neill

[57] ABSTRACT

In a method for developing attractions in a shooting game system with which players can experience gun fights between the targets and players themselves. The shooting game system can be easily installed in a short period anywhere and game quality can be adjusted in the most suitable state. The method for developing attractions includes the steps of producing various types of targets by combining fundamental mechanisms, each of which is used for a unit operation; incorporating unified control equipment and peripherals in the produced target to make them a target unit; embedding the above-described target unit in a target unit case so as to serve also as an indoor partition and posts; and arranging the embedded target units in the designated rooms of the attraction hall. The method for developing attractions alternatively includes inputting information regarding the arrangement of the targets, displaying the arrangement on a screen, and the interaction between the targets and the players. This method thereby allows monitor and control of game quality.

5 Claims, 6 Drawing Sheets

KIT FOR DEVELOPING ATTRACTIONS IN A SHOOTING GAME SYSTEM

This application is a divisional of application Ser. No. 08/418,029, filed on Apr. 6, 1995, now U.S. Pat. No. 5,613,913, the entire contents of which are hereby incorporated by reference.

BACKGROUND OF THE INVENTION

1. Field of the Invention

The present invention relates to a method for developing attractions in a shooting game with which players can experience gun fights between targets and the players themselves by arranging robot targets in an attraction hall.

2. Description of the Related Art

Games in which players play to shoot targets arranged in playing spots with model guns (rifles and the like) include competition shooting games that robot targets and players gun fight with each other. Targets used in these competition shooting games only perform very simple operations, although they are called robot targets. In addition, directions of guns used by the robot targets are nearly fixed. Hence, the targets shoot at fixed positions only. Therefore, depending upon the arrangement of the targets, game quality changes remarkably. Accordingly, by always arranging targets with the same arrangement in the same size attraction hall, game quality can be maintained.

However, when the competition shooting game is developed in a theme park (a park designed under a unified theme), stage settings, partitions, posts, and the like are incorporated as indoor facilities in a park layout design. Therefore, considerable expense is expended for every installation in an attraction hall. In addition, the higher the game quality is, and the higher the degree of players' participation is, the more difficult the adjustment of the game quality becomes. Therefore, even if veteran engineers on a system install targets and related equipment in the system, much adjustment time is necessary. Due to this, the period from the start of building the attraction to the opening of the attraction is long. Further, when several attractions are desired to be developed simultaneously, many attraction-specific engineers would have to be trained. These problems are reasons why few attractions in theme parks have high degrees of players' participation and high game quality.

SUMMARY OF INVENTION

The present invention is intended as a solution to the aforesaid problems. A first object of the present invention is to provide a method for developing attractions in a shooting game system with which the shooting game system can be easily installed in a short period anywhere by unifying a target body, a partition, posts and the like. Further, a second object of the present invention is to provide a method for developing attractions in a shooting game system with which game quality can be always set in the most suitable state.

As described above, the present invention may be provided by a method for developing attractions in a shooting game with which players can experience gun fights between targets and the player themselves by arranging robot targets in an attraction hall. Therefore, the above-described first object of the present invention can be attained in accordance with the following process. The process includes the steps of: producing various types of targets by combining fundamental mechanisms, each of which is used to for a unit operation; incorporating unified control equipment and peripherals in the produced targets to make them a target unit; embedding the target units in target unit cases respectively; and arranging the target units in the predetermined rooms of the attraction hall to develop attractions.

Further, the second object can be attained in accordance with the following process. The process includes the steps of: inputting arrangement information of the targets, which are arranged in a designated room of the attraction hall, to a control system of the shooting game system to save the information in a memory; displaying an arrangement state of the targets on a monitor display on the basis of the arrangement information saved in the memory so that the arrangement state in the room can be confirmed on the monitor display; and simulating a shooting game, which is the gun fight between the targets and players on the basis of input operational information on players and the arrangement information of targets saved in the memory so that the game quality in the arrangement can be examined.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
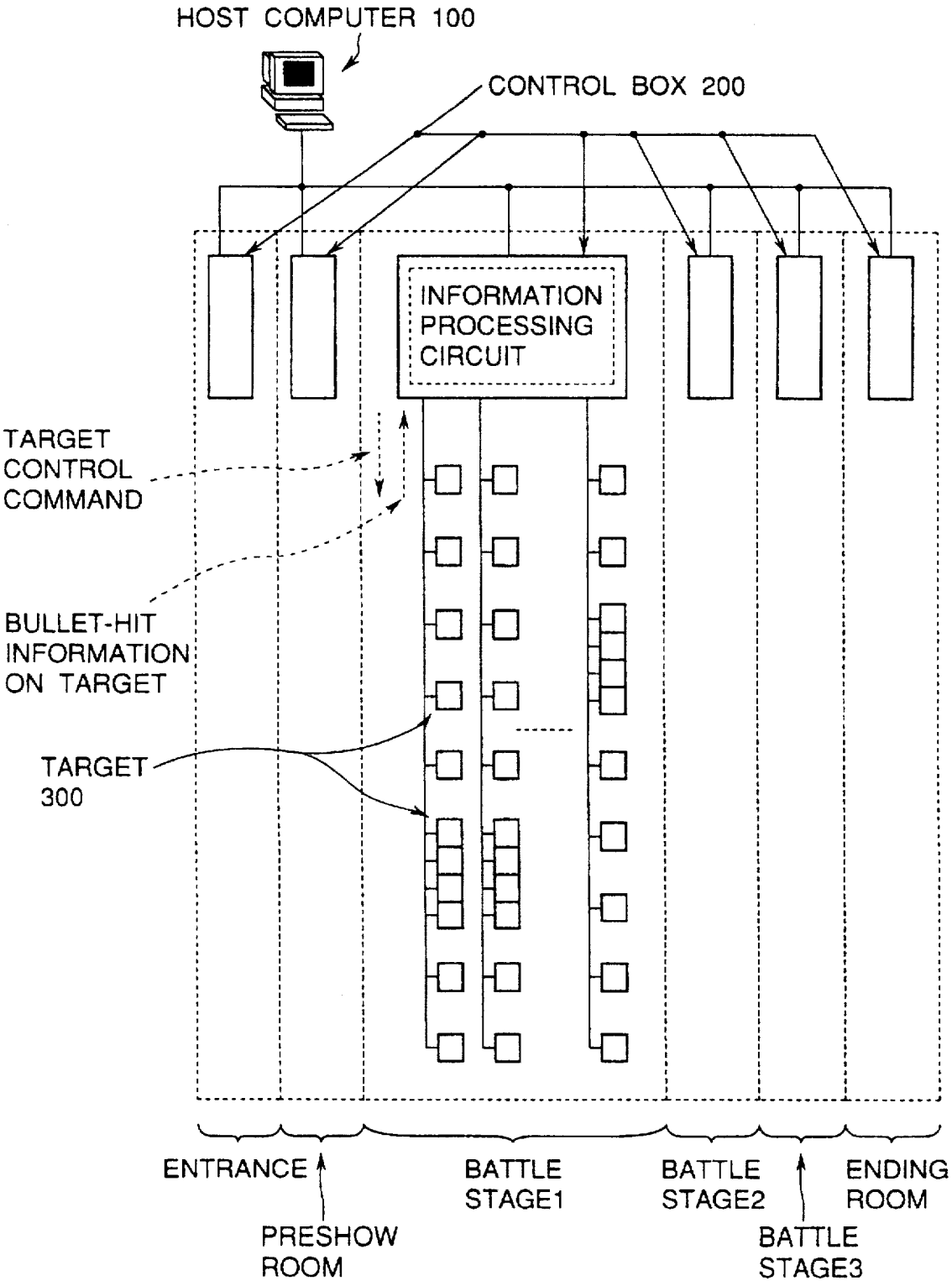
FIG. 1 is a schematic diagram showing an example of an entire shooting game system according to the present invention.

In the present invention, target units are constructed with fundamental mechanisms and control equipment. The constructed target units are installed into target unit cases respectively to be installed in an attraction hall. In addition, the target unit cases are formed to also serve as partitions and posts in rooms. Therefore, various types of targets can be easily produced, and plenty of targets can be easily installed in a short period of time anywhere.

In addition, arrangement information of targets is input to a control system of a shooting game system, and is saved in a memory. Therefore, when the shooting game is executed, the operation of the targets can be controlled with the control system of the shooting game system, based on the arrangement information of the targets. Hence, the game quality can be automatically adjusted to some extent. Furthermore, it is possible to display the arrangement state of targets on a monitor display, and further to simulate the shooting game on a screen. Therefore, if there is a problem with an environmental factor such as arrangement, it is easily confirmed. Hence game quality can be set in a most suitable state.

Hereinafter, preferred embodiments of the present invention will be described with reference to the drawings.

First, the outline of the entire system will be described with reference to FIG. 1, which is a schematic diagram showing an example of an entire constitution of a shooting game system according to the present invention. A room for a shooting game that is provided in an amusement facility is partitioned into a plurality of rooms: an entrance room where reception for the game, explanation of the game with a large monitor display for guidance, delivery of guns, and the like are done; a preshow room for preparing the game; battle stage rooms 1 to 3 where gun fights with targets are played; and an ending room where players receive personal results or team results. Therefore, a player or each team composed of a plurality of players play within the rooms.

A host computer 100 controls an entire system, and a control box 200 controls each room. The host computer 100 is connected to the control box 200 for each room via optical communication, executes the centralized control of the entire system, such as the flow of players through the room, start/stop of the game, data acquisition, totaling, and reporting, and controls the progress of the game. The control box 200 for each room is preferably a single frame from a hardware point of view, and controls a subsystem in each room in accordance with commands from the host computer 100.

Here, the only control in the battle stage rooms, according to the present invention, will be explained. In the battle stage rooms 1 to 3, the respective control box 200 transmits target control commands to the targets 300 via optical communication, and mainly controls many targets 300 (control of appearance, aiming, shooting, and the like). Each target 300 receives the target control command as follows; the target appears from the back of a post; the target aims at a player with a gun; and/or the target attacks the player. Each target 300 has a means for detecting bullet hitting and means for detecting players' positions. Detected information on bullet-hit targets and on players' positions is transmitted to the control box 200 via optical communication. In this manner, in the battle stage rooms 1 to 3, the respective control box 200 controls various operations of each target 300 on the basis of predetermined information, the command information from the host computer 100, and the dynamic information sent from each target 300.

In a shooting game system like that in FIG. 1, many types of robot targets are installed in a play hall. When these types of attractions are developed in a theme park, according to a conventional method for developing attractions, considerable expense is required and a period from the start of building of the attraction to the opening of the attraction is long. By using a shooting game system with the above-described system configuration, a method for developing attractions in the shooting game system will be explained below.

Figure 2:
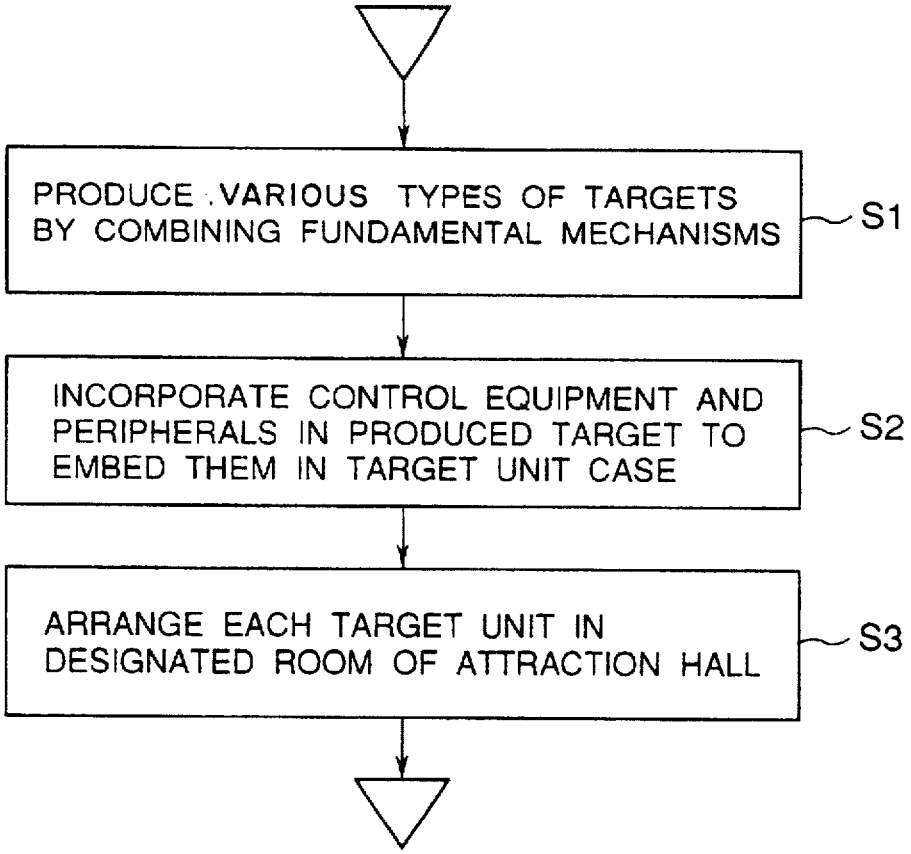
FIG. 2 is a flow chart for explaining a first embodiment of a method for developing attractions in a shooting game system according to the present invention.

FIG. 2 is a flow chart showing a procedure of a first embodiment of a method for developing attractions in a shooting game system according to the present invention. This procedure until includes steps up until installation of targets in an attraction hall. According to the flow chart of FIG. 2, first of all, in a production process of targets, various operation types of targets are produced by combining fundamental mechanisms. The more types of robot targets there are, the more contents of a game system are well filled, while design and production per robot type need much labor and time. Therefore, by combining fundamental mechanisms that have unit operations, such as vertical movement, horizontal movement, tilting, and rotation, and that are produced beforehand, various operation types of targets can be easily produced (Step S1).

In addition, control equipment and peripherals are incorporated in the produced targets to make them a target unit which are embedded in a target unit case. The target unit case is formed beforehand to also serve as an indoor partition and posts. There are various types of targets such as: a type that usually hides in the back of a post, appears for attacking, and hides again; a type that appears when a player approaches; etc. Therefore, so that the target unit case itself can be installed without foundation work such as partitioning, the target unit case is formed beforehand to also serve as a partition and posts.

Figure 3:
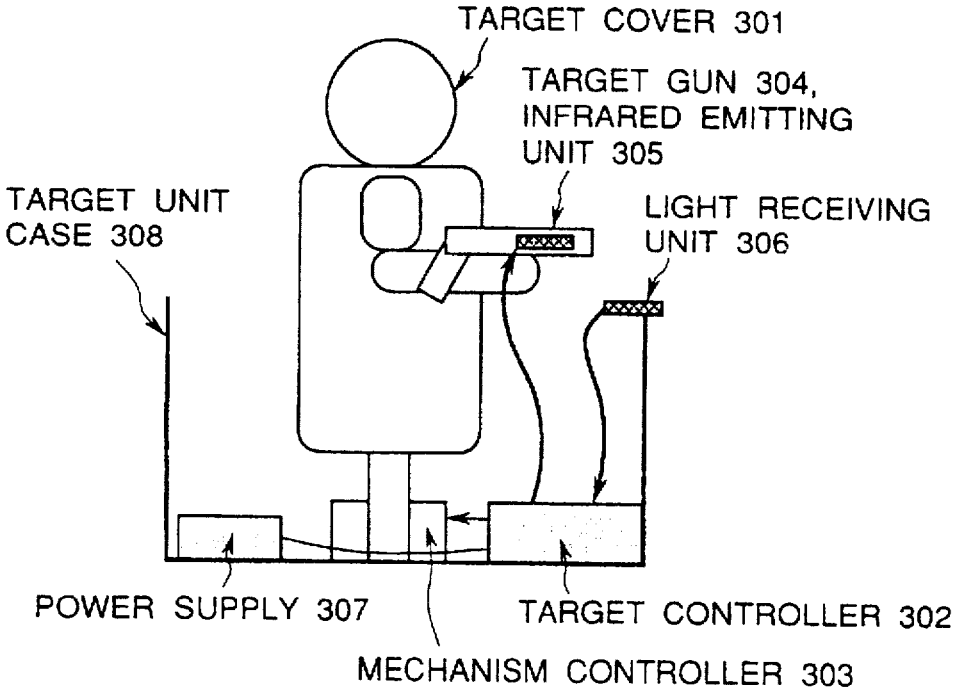
FIG. 3 is a structural diagram showing a first physical example of a target assembled according to a method of the present invention.

FIG. 3 is a structural diagram showing a first physical example of a target assembled in accordance with the above-described method. The target includes: a target cover 301; a target controller 302 for controlling target operations and output of sound effects; a mechanism controller 303 for controlling operation mechanisms of the target by a command from the target controller 302; a target gun 304 that is a gun unit for the target; an infrared emitting unit 305 that emits infrared light corresponding to a bullet; a light receiving unit 306 for detecting infrared light shot (emitted) by a player; and a power supply 307. Further, these target units are incorporated in a target unit case 308.

As shown in FIG. 3, all of the control equipment and peripherals are integrated in a single unit. A target appearance is depicted by covering the target body composed of fundamental mechanisms, which are not shown, with the target cover 301. That is, by covering the target bodies with the target covers having various appearances, targets having various appearances can be depicted. In addition, a target unit case 308 for the type of target appearing from a post is in the shape of a post or box.

Figure 4:
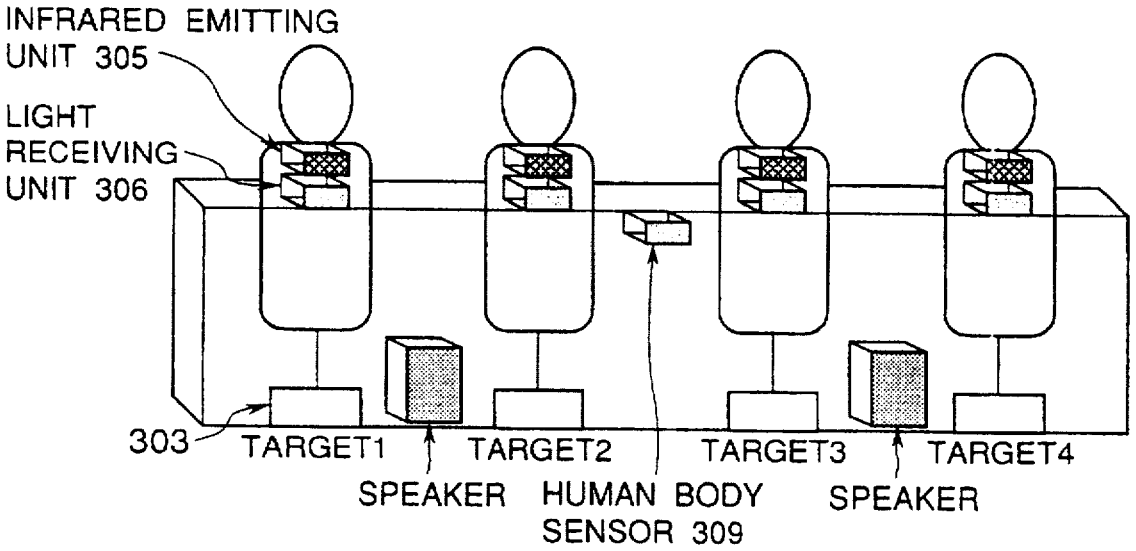
FIG. 4 is a structural diagram showing a second physical example of a target assembled according to a method of the present invention.

FIG. 4 is a structural diagram showing a second physical example of a target assembled in accordance with an above-described method. The configuration shown in FIG. 4 includes a target unit case 308 in which one target controller 302 controls four targets and two sound systems. The configuration in FIG. 4 also includes a human body sensor 309, e.g., a pyro-electricity sensor, which detects a player. Each target 300 attacks the player when the sensor 309 detects the player in the area where the target 300 can attack the player. In this manner, by combining fundamental units, various types of targets can be assembled. As shown in FIG. 4, by installing a plurality of target units in a target unit case, fundamental units can be commonly used, and targets can be installed more easily in the attraction hall (Step S2).

Furthermore, by arranging target units installed in the target unit cases in the designated rooms, installation of targets is completed (Step S3). Further, although the target unit cases described above are formed so as to also serve as partitions and posts, of course, it is possible to attach partitioning units and posts to fundamental target unit cases such that they are integrated therewith.

Figure 5:
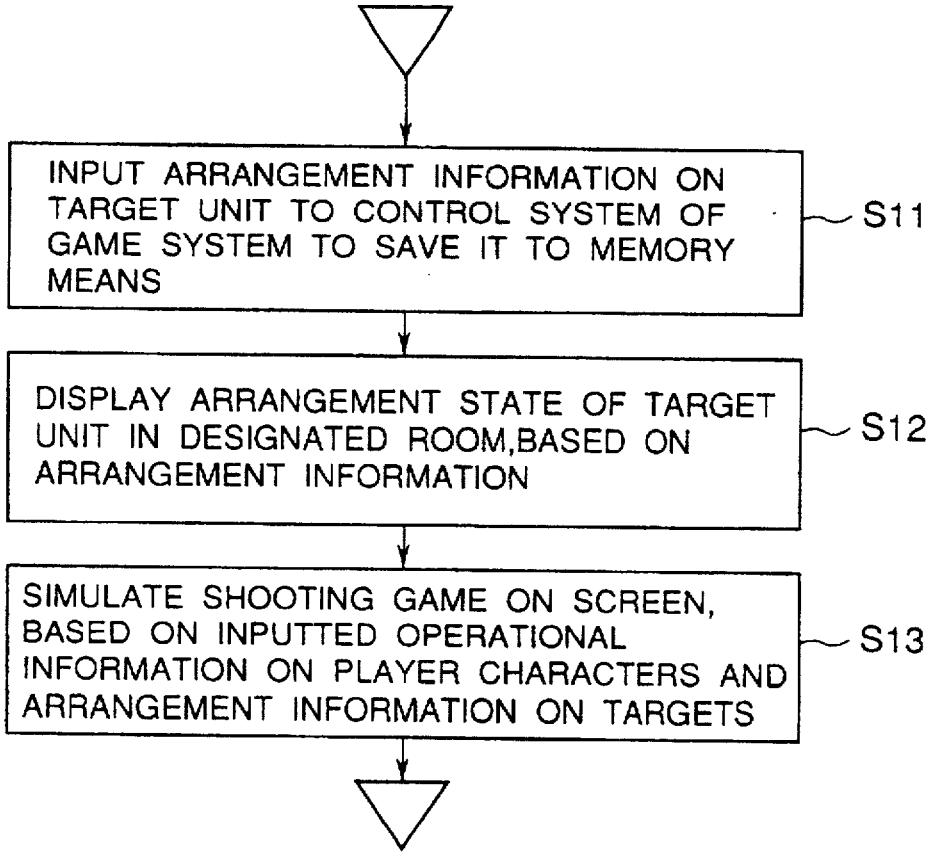
FIG. 5 is a flow chart for explaining a second embodiment of a method of the present invention.
Figure 6A:
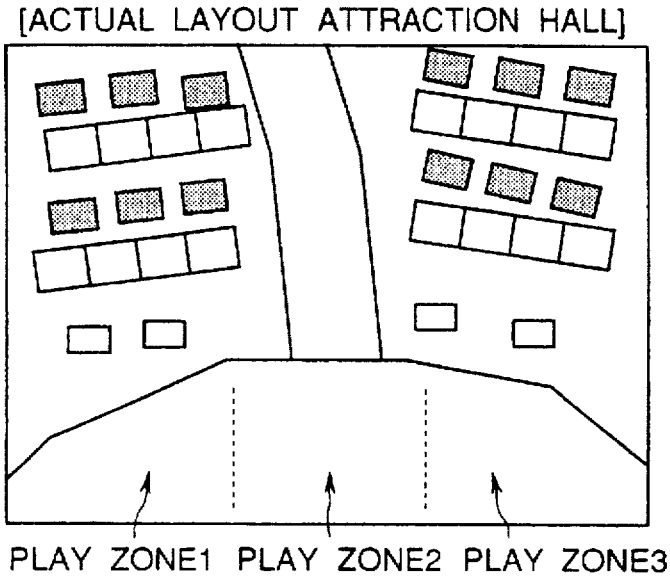
FIGS. 6A, 6B and 6C are drawings for explaining the second embodiment of a method of the present invention.
Figure 6B:
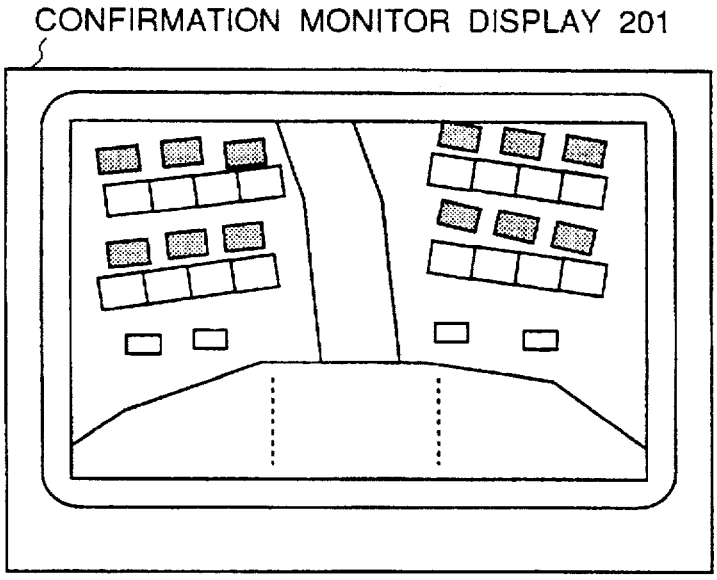
Figure 6C:
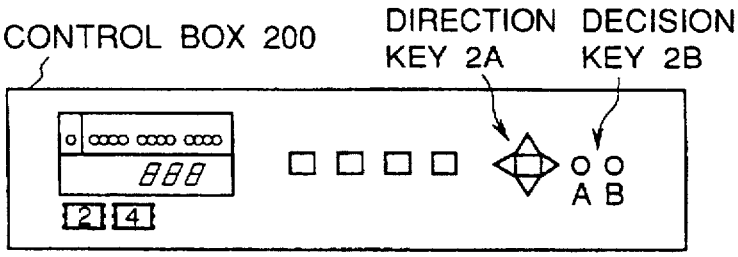

FIG. 5 is a flow chart showing a second embodiment of a method for developing attractions in a shooting game system according to the present invention. FIG. 5 shows a procedure from inputting arrangement information of targets to the control system to simulating the game. With reference to FIGS. 6A, 6B and 6C, the second embodiment will be described according to the flow chart in FIG. 5. First of all, on the basis of the actual layout of an attraction hall (FIG. 6A), arrangement information of target units is entered one by one with a select key 2*a* (direction key) and decision keys 2*b* (FIG. 6C). Examples of the arrangement information input include positions (three-dimensional positions) of the targets in the attraction hall, angles of the targets in the attraction hall, and the play zone where target guns aim players. The input arrangement information is saved in a memory of a corresponding control box 200 (Step S11).

The control box 200 follows a display instruction by an operator, and, on the basis of the input arrangement information, schematically displays the arrangement state of the targets in the designated room on a confirmation monitor display as shown in FIG. 6B. Since the target units displayed on the display have schematic shapes of actual target units, the actual arrangement can be accurately recognized only by looking at the confirmation monitor display (Step S12). Further, on the basis of the arrangement information of the targets, the shooting game consisting of gun fights between targets and players can be simulated (Step S13). In addition, Steps S12 and S13 do not need to both be performed or be performed sequentially, i.e., confirmation of the arrangement state and simulation of the game can be alternatively optionally executed by the operator's command.

Figure 7:
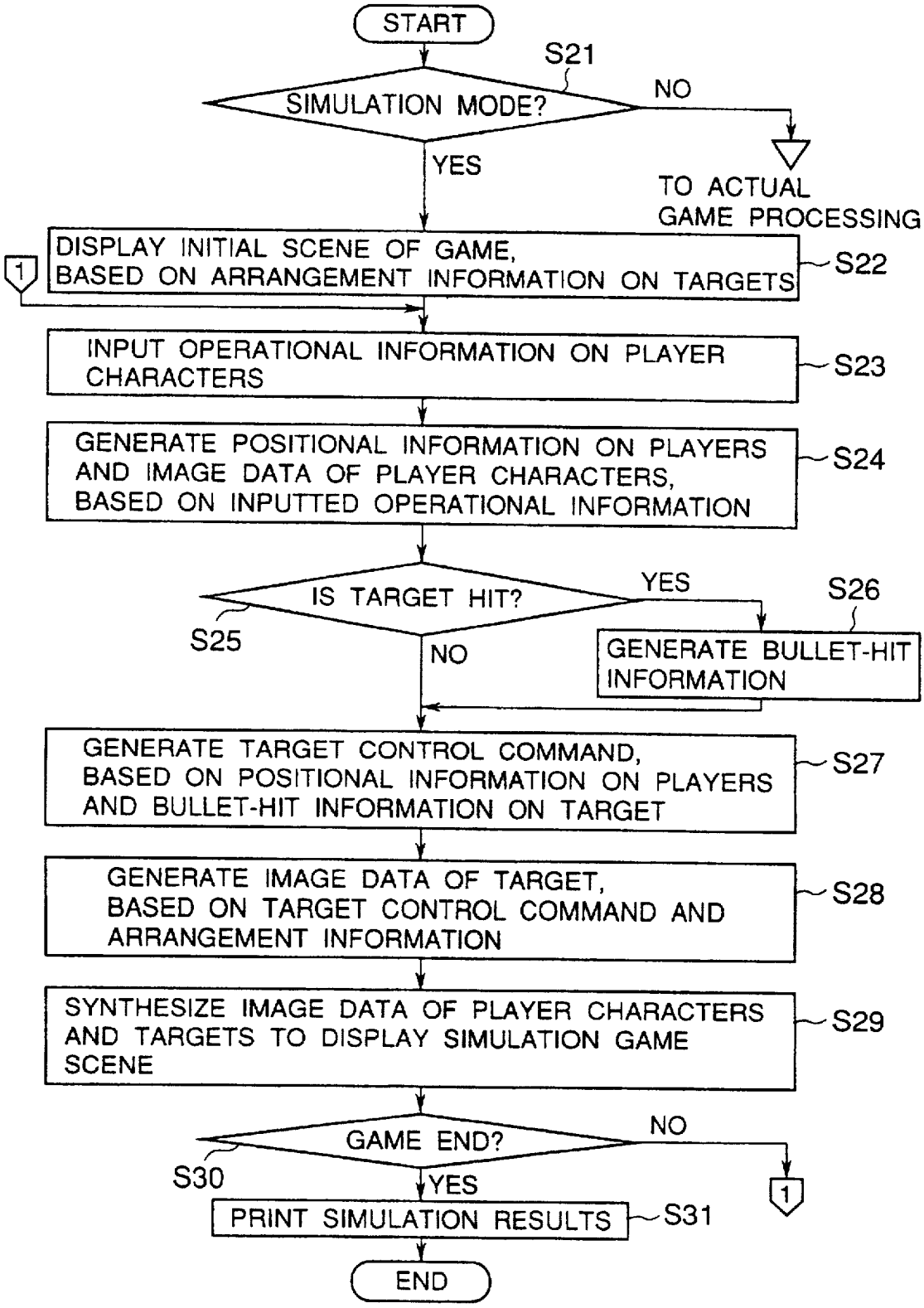
FIG. 7 is a flow chart for explaining an outline of simulation processing in FIG. 5.

Next, according to the flow chart in FIG. 7, the outline of the simulation processing will be described. In an actual shooting game, the detected information on the bullet-hit targets and on players' positions is transmitted to the control box 200 via optical communication. On the basis of the input arrangement information of targets and the detected information of bullet-hit targets and on players' positions, various operations of each target 300 are controlled. In the simulation mode, the game is simulated on the basis of the same information.

When the system is in the simulation mode, the control box 200 displays a scene in the designated battle stage that room in accordance with the arrangement information of the targets, for example, a scene shown in FIG. 6B. Further, player characters corresponding to actual players are displayed on a screen (Steps S21 and S22). An operator starts a shooting game on the screen with a start command, operates movement of the player characters and handling of guns with a direction key 2*a* and decision keys 2*b* in an operation panel, and executes a simulation game. Here, operational information on the player characters can be input from not only the operation panel but also common input apparatuses. Hence, on the basis of information input from each input apparatus, a shooting game composed of a plurality of players and targets can be simulated (Step S23).

On the basis of the input operational information on player characters, the control box 200 generates positional information on players and image data of player characters (Step S24), and, if a target is hit with a bullet, the control box 200 generates bullet-hit information on the target (Steps S25 and S26). In addition, on the basis of the positional information on players and the bullet-hit information on the target, the control box 200 generates a target control command (Step S27). Namely, processing at the Step S27 is the same as that in the actual game, and, as processing for simulation, the processing for displaying on a screen the result of simulating operations of players and targets is merely added to the control box 200.

Subsequently, the control box 200, on the basis of the target control command and arrangement information, generates image data of the target (Step S28), and displays a game scene by synthesizing image data of player characters and targets (Step S29). Furthermore, if the game is not completed, the process returns to the Step S23 and the control box 200 repeats the above steps. If the game is completed, the control box 200 prints the simulation results and completes the processing (Steps S30 and S31). By executing the simulation as described above and looking at simulated scenes, the operator confirms the game quality. Players' results, as would be generated in the actual game, are printed as simulation results. By looking at these results, the operator confirms the overall game quality.

In addition, in the above-described embodiment, since the actual stage layout is designed beforehand, a method for displaying an arrangement state and executing simulation is described. Alternatively, it is possible to initially display a scene having a fundamental layout on a screen, to arrange targets on the screen in an arrangement state to design the layout in a battle stage, to execute simulation of the game on the basis of the arrangement state, and to design the most suitable arrangement in the actual stage. In that case, for example, on the basis of the layout information on the battle stage room and arrangement information on the targets, a plan for the designated battle stage room can be generated.

As described above, according to a method for developing attractions in a shooting game system, by unifying a target and a partition and/or posts, the following effects can be obtained.

1) Since an operation check per unit can be done in a production site, reliability increases.
2) The original design and inventory control of parts become remarkably easy.
3) Installation becomes simple, and an installation period and expense can be reduced.
4) Since a failed unit can be exchanged with merely another unit, this is advantageous in the viewpoint of business.

In addition, by displaying an arrangement state of targets on the basis of arrangement information input to a system, and further executing a simulation of a shooting game on a screen, the following effects can be obtained.

1) A game whose game quality is remarkably changed by an arrangement method of targets cannot display the same game quality unless the game system is arranged in accordance with the same method and direction. However, by inputting the arrangement information, monitoring of the game quality becomes remarkably easy.
2) Since the game quality can be simulated on a monitor display on the basis of the input arrangement information, adjustment of the game quality becomes simple, and hence a specified engineer is not required.
3) This adjustment may correspond to a minor layout change, thereby improving game quality with minimal time and expense.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shooting game kit comprising:

targets formed by combining fundamental mechanisms;

control equipment which controls said targets;

target unit cases; and means for embedding said targets and control equipment in respective ones of said target unit cases, wherein said target unit cases are adapted to serve as at least one of partitions and posts when located at respective desired positions.

2. The kit according to claim 1, wherein each of said fundamental mechanisms is used for a unit operation.

3. The kit according to claim 2, wherein said unit operations include vertical movement, horizontal movement, tilting, and rotation.

4. The kit according to claim 1, further comprising a target cover which is adapted to cover a target body composed of said fundamental mechanisms.

5. The kit according to claim 4, wherein said target cover is easily replaceable with another target cover.

* * * * *